US009722329B2

(12) United States Patent
Daume

(10) Patent No.: US 9,722,329 B2
(45) Date of Patent: Aug. 1, 2017

(54) APPARATUS FOR MAKING ELECTRICALLY CONDUCTIVE CONTACT

(71) Applicant: Quesy GmbH & Co. KG, Burgwedel (DE)

(72) Inventor: Britta Daume, Burgwedel (DE)

(73) Assignee: Quesy GmbH & Co. KG, Burgwedel (DE)

( * ) Notice: Subject to any disclaimer, the term of this patent is extended or adjusted under 35 U.S.C. 154(b) by 0 days.

(21) Appl. No.: 14/993,910

(22) Filed: Jan. 12, 2016

(65) Prior Publication Data

US 2016/0204527 A1 Jul. 14, 2016

Related U.S. Application Data

(63) Continuation of application No. PCT/EP2014/001906, filed on Jul. 11, 2014.

(30) Foreign Application Priority Data

Jul. 12, 2013 (DE) ..... 10 2013 107 430

(51) Int. Cl.
*H01R 4/60* (2006.01)
*H01R 4/64* (2006.01)
*H01R 4/50* (2006.01)

(52) U.S. Cl.
CPC ..... *H01R 4/643* (2013.01); *H01R 4/60* (2013.01); *H01R 4/646* (2013.01); *H01R 4/5016* (2013.01)

(58) Field of Classification Search
CPC ..... H01R 4/646; H01R 4/643
See application file for complete search history.

(56) References Cited

U.S. PATENT DOCUMENTS 1,991,075 A * 2/1935 Bloomquist ..... H01R 11/15 403/191
3,530,898 A 9/1970 Wilson
(Continued)

FOREIGN PATENT DOCUMENTS

AU A-60759/96 11/1996
DE 869 580 3/1953
(Continued)

OTHER PUBLICATIONS

International Search Report for PCT/EP2014/001906, dated Aug. 26, 2014 (2 pages).
EP Office Action, dated Jun. 2, 2014 (8 pages).

*Primary Examiner* — Briggitte R Hammond
(74) *Attorney, Agent, or Firm* — Shlesinger, Arkwright & Garvey LLP

(57) ABSTRACT

Apparatus for making electrically conductive contact with an electrically conductive, elongated, body, for example a pipe or cable. Apparatus includes a base body having a metal carrier element configured as a clamp clampable around body to be contacted, and open in circumferential direction. Apparatus includes a connecting device with a connecting member, by which ends of carrier element are connectable or connected to one another when mounted. Apparatus has a contact device for establishing electrically conductive connection between body contacted and conductor, such as grounding cable. A connecting member configured for cooperating with a guide device for guiding translatory motion of connecting member, and situated at free ends of carrier element so that in mounted position of apparatus, translatory motion of the connecting member between a guide start and a guide end of guide device achieves a nondestructively detachable form fit, connecting free ends of the carrier element.

20 Claims, 10 Drawing Sheets

(56) References Cited

U.S. PATENT DOCUMENTS

| | | | | | |
|---|---|---|---|---|---|
| 4,257,658 | A * | 3/1981 | Hammond | H01R 4/646 | 174/78 |
| 4,842,558 | A | 6/1989 | Strand | | |
| 4,997,148 | A * | 3/1991 | Sherman | F16L 3/10 | 24/279 |
| 5,429,532 | A * | 7/1995 | Auclair | H01R 4/643 | 439/793 |
| 5,435,506 | A * | 7/1995 | Wiley | F16L 3/10 | 248/74.1 |
| 5,616,036 | A * | 4/1997 | Polidori | H01R 4/60 | 248/74.1 |
| 5,911,585 | A | 6/1999 | Zwit | | |
| 6,441,303 | B1 | 8/2002 | Daume | | |
| 7,018,221 | B2 | 3/2006 | Daume | | |
| 2005/0048815 | A1 | 3/2005 | Daume | | |
| 2008/0108234 | A1* | 5/2008 | Clark | H01R 4/36 | 439/108 |

FOREIGN PATENT DOCUMENTS

| | | |
|---|---|---|
| DE | 1 899 226 | 8/1964 |
| DE | 39 20677 A1 | 4/1990 |
| DE | 695 06 887 T2 | 7/1999 |
| EP | 0 744 788 A1 | 11/1996 |
| EP | 0 978 678 B1 | 11/2000 |
| EP | 0 987 483 B1 | 4/2001 |
| EP | 0 982 524 B1 | 5/2001 |

* cited by examiner

APPARATUS FOR MAKING ELECTRICALLY CONDUCTIVE CONTACT

CROSS-REFERENCE TO RELATED APPLICATIONS

This application is a continuation of application no. PCT/EP2014/001906, filed 11 Jul. 2014, and this application claims the priority of German Application No. 10 2013 107 430.8, filed 12 Jul. 2013, and each of which is incorporated herein by reference.

FIELD OF THE INVENTION

The invention relates to an apparatus for making electrically conductive contact. More particularly, this invention relates to an apparatus for making electrically conductive contact with an electrically conductive, in particular elongated, for example substantially cylindrical, body, for example a pipe or a cable. A cable of this type may be designed, for example, as a glass fiber cable whose outer periphery is covered, at least in sections, in an electrically conductive manner, for example by use of an electrically conductive metal braid or an electrically conductive shield.

BACKGROUND OF THE INVENTION

Apparatuses of this type for making electrically conductive contact are known in different forms, for example as a so-called grounding clamp, among others.

An apparatus for making electrically conductive contact with an electrically conductive part of a pipe or cable is known from EP 0744788 A1, among others, in which in particular an electrically conductive connection between a bared outer conductor of a coaxial cable and a conductor, for example a grounding cable, is used.

An apparatus is known from EP 0 987 483 B1, EP 0 982 524 B1, and EP 978678 B1, having a carrier element designed as a clamp which is clampable around the coaxial cable to be contacted, and which is open in the circumferential direction and has a connecting means via which the ends of the carrier element, which are free in the circumferential direction, are connectable or connected to one another in the mounted position. In addition, the known apparatuses have a contact means for establishing an electrically conductive connection between the body to be contacted and a conductor, in particular a grounding cable.

In the apparatuses of the known type, the connecting means is formed, for example, by screw or rivet connections, for example a free end of the carrier element having at least one threaded hole into which the screw, which functions as a connecting member, is screwed in for a connection with the remaining end of the carrier element. The screw is guided through a recess at the above-mentioned remaining end.

The known apparatuses must be appropriately secured by the connecting means in order to achieve a firm hold on the body to be contacted. It has been shown that a comparatively large number of single parts or tools are used in order to connect the free ends of the carrier element to one another in the mounted position.

OBJECTS AND SUMMARY OF THE INVENTION

An object of the invention is to provide an apparatus which allows a quicker and also more secure connection of the ends of the carrier element, and likewise allows secure electrical contacting of an electrically conductive body.

For achieving the stated object, firstly, the invention departs from the concept of providing the necessary connecting device with the same dimensions and design, in order to simplify handling for fastening the connecting member.

Furthermore, the invention departs from the basic concept of nondetachably connecting the free ends carrier element to one another, as a result of which the ends of the carrier element would be separable from one another only by destroying them in order to then be able to remove the apparatus, described at the outset, from the body in question to be electrically contacted.

In contrast, the invention also pursues the objective of achieving a resource-conserving solution with which the number of various single parts may be reduced, and likewise, a secure connection of the ends of the carrier element is possible.

The object is achieved by the features set forth herein. In addition, advantageous further embodiments of the invention are set forth in the description, Figs., and claims.

For achieving the stated object, the invention is based, firstly, on the basic concept of changing the type of connection in order to achieve a secure connection of the ends, free in the circumferential direction, of the carrier element, which is configured and shaped as a clampable clamp, by using a connecting member to be able to achieve a form-fit connection by means of a motion of the connecting member, which in particular is essentially exclusively translatory, in the resulting axial direction in the mounted position, for the movement of the carrier element.

The above-mentioned axial direction of an apparatus according to the invention for the movement of the carrier element in the mounted position initially results transversely with respect to the circumferential direction, in which the carrier element, in its configuration as a clampable clamp, surrounds or encloses, and thus ultimately encompasses, the body to be electrically contacted.

In addition, for elongated bodies the above-mentioned axial direction of an apparatus according to the invention results in particular parallel or essentially coaxially with respect to the longitudinal extension of the body to be electrically contacted or the contacting section thereof, which is provided for mounting an apparatus according to the invention.

An apparatus according to the invention results, firstly, in the advantage that a motion transformation, which is the case for a screw connection, for example, in which a rotatory movement is transformed into a translatory motion of the connecting member in order to achieve a connecting function, does not occur.

According to the invention, in a mounted position an axis of the carrier element results in which the carrier element is situated on the body to be electrically contacted, wherein the carrier element in the circumferential direction in which an apparatus according to the invention surrounds or encloses the body to be electrically contacted, at least in sections, or with respect to the above-mentioned axis. This likewise results in a mounted position within the meaning of the invention.

Against this background, this results in advantages for assembly and disassembly, and also for maintenance time and costs.

In addition, the advantage results that the number of single parts necessary for meeting the function of an apparatus according to the invention is reduced compared to existing approaches. Furthermore, a secure connection of the ends of the carrier element is likewise made possible without the need for further securing elements, for example adhesives or retaining means.

According to the invention, at least one connecting member is therefore configured and shaped for cooperating with a guide device for guiding the translatory motion of the connecting member, which is situated at the free ends of the carrier element.

This takes place in such a way that in the mounted position of the apparatus, a translatory motion of the connecting member between a guide start and a guide end of the guide device brings about a form fit, which is in particular nondestructively detachable, for connecting the free ends of the carrier element.

This results in the advantage that, due to purely translatory motions of the connecting member, the ends of the carrier element, which are free in the circumferential direction, are easily connectable or connected to one another in the mounted position via a form fit by means of the connecting member.

In addition, the advantage results that the ends of the carrier element, configured as a clamp, are uniformly connected by the connecting member. It is thus likewise possible to correspondingly uniformly hold a sealing member or apply a corresponding uniform compressive force to the sealing member.

According to the invention, results from the fact that, due to the guide device, the degrees of freedom of motion of the connecting member are reduced to a translatory motion, preferably in one direction, thus simplifying handling thereof.

Furthermore, the freedom of motion of the connecting member in the axial direction is thus limited to a clamp axis (or carrier element axis) which results, in the mounted position.

A significant advantage resulting from guiding the translatory motion of the connecting member is that the connecting member is easy to handle, since it is easily possible to move the connecting member via the guide device or guide in a different movement direction than the movement direction specified by. Accordingly, the guide device brings about a forced guidance of the connecting member for moving between the above-mentioned guide start and guide end. Reliable handling of the apparatus is likewise facilitated in this way.

Moreover, due to cooperation of the connecting member with the guide device, which is formed at the free ends, a form-fit connection of the free ends of the carrier element is easily possible via an additional aid, the connecting member.

An apparatus according to the invention results in the advantage that the size may be kept very small, thus reducing the space requirements, and enabling a compact arrangement of multiple electrically conductive bodies, for example as a pipe or cable package.

This also results in the advantage that an apparatus according to the invention is particularly easy, and therefore cost-effective, to manufacture.

Furthermore, the advantage results that an apparatus according to the invention is easily handled during installation as well as during maintenance operations. In addition, the advantage results that the number of necessary single parts of an apparatus according to the invention for installing same on a body in question is reducible to a minimum.

The guide device may guide the connecting member in various ways, so that a translatory motion in the axial direction along corresponding movement curves, or in degrees of freedom in correspondingly different movement directions, is possible.

For further simplifying the handling of an apparatus in question, according to the invention it is provided that the connecting member is electrically conductive, and in the mounted position, in which the connecting member is situated on the guide device between a guide start and a guide end for a form-fit connection of free ends of the carrier element, electrically contacts the carrier element, wherein in the mounted position, in particular the conductor, preferably the grounding cable, is situated on the connecting member preferably with its free electrically conductive ends, and is connected to the connecting member in an electrically conductive manner.

For electrical conduction, within the scope of the invention it is provided that the carrier element is likewise conductive, at least in sections, to be able to electrically conduct currents from/to bodies to be electrically contacted, via the connecting member and a conductor situated therein.

In particular for very high currents, which occur during lightning strikes, for example, excellent conductivity is crucial so that an apparatus according to the invention experiences preferably no damage and reliably conducts the currents that occur.

For this purpose, the carrier element in particular is made of a material which contains or is made of metal.

Within the meaning of the invention, as already stated above, a mounted position of the apparatus is determined by the arrangement of the carrier element on the body to be electrically contacted, on which the carrier element, configured as a clampable clamp, is situated in order to be contacted. For the following statements or features concerning an apparatus according to the invention, in particular the mounted position is assumed or imputed, even if this is not explicitly mentioned. Deviations therefrom are explicitly mentioned or are apparent from the context.

For facilitating easier handling and speeding up the connection operation, in one advantageous further embodiment of the invention it is provided that the guide device for the connecting member is formed by at least one first guide situated at one free end of the carrier element, and by a second guide situated at the remaining free end, in particular the first guide and/or the second guide each being elongated in the axial direction of the carrier element.

Within the meaning of the invention, as already stated above, the axial direction of the carrier element is determined by the carrier element, which in the mounted position is situated on the body to be electrically contacted, as a result of which the axis or the axial direction of the base body/carrier element follows the direction of longitudinal extension of the body or cable to be electrically contacted.

To further reduce the freedom of motion of the connecting member, in another advantageous further embodiment of the invention it is provided that the first and the second guides are configured as a linear guide, at least in sections.

According to the invention, a linear guide is understood to mean guiding of the translatory motion for the connecting member, in which the movement direction is essentially linear, and changes in the movement directions of the connecting member do not occur.

In this way, the linear guide is manufacturable in a cost-effective manner, in which, for example, the linear guide may be elongated in a straight line or formed by a corresponding projection. As soon as a form-fit connection of the ends, free in the circumferential direction, of the carrier element is established due to the cooperation of the connecting member and the first and second guides, in particular the guide member has reached a guide end of the first or second guide, it is advantageous that a further movement of the guide member along the guide is prevented in order to avoid undesirable loosening of the above-mentioned connection or a reduction in the security of the connection. According to the invention, this may be achieved, for example, by the shaping of the above-mentioned guides, which is the subject matter of one advantageous further embodiment below.

The guides for the connecting member may be implemented in various ways according to the invention. For example, it is possible to use a profiled body which is appropriately designed and configured for guiding the translatory motion of the connecting member, and by means of which a guide is formed in the manner of a rail guide for the connecting member. In addition, it is possible to integrally mold a guide onto the carrier element, for example by non-cutting machining or forming processes or also by cutting machining of the carrier element. Alternatively, it is possible, for example, to use an integrally joined type of connection.

To this end, another advantageous further embodiment of the invention provides that the first guide and/or the second guide are/is integrally molded onto the carrier element of the base body.

According to the invention, motion control for the guide member is achievable in various ways by at least one of the above-mentioned guides. As stated above, the guide may be easily configured in the manner of a groove. Accordingly, in another further embodiment of the invention it is provided that the first guide and the second guide each have at least one guide groove, which in the mounted position is elongated in the axial direction of the carrier element, and with which in each case at least one guide element of the connecting member engages, at least in sections, for guiding the translatory motion.

Within the meaning of the invention, guiding the translatory motion of the connecting member takes place in the direction of the longitudinal extension of a guide or guide groove, which in the mounted position is formed in particular in the axial direction of the carrier element.

For predetermined or directed movement guiding, the movement partners, which comprise at least the connecting member and at least the first and second guides, are coordinated with one another with respect to the guide elements or guide surfaces, in order to appropriately guide the connecting member by means of the mutually corresponding surfaces via which the connecting member comes into contact with the guide device of the carrier element in order to guide the translatory motion of the connecting member.

For guiding the movement of the connecting member by the guide device of the carrier element, in another further embodiment of the invention it is considered that the guide element of the connecting member is formed by at least one projection, directed toward the guide groove in the mounted position, or a protruding welt directed toward the guide groove, or at least one, in particular multiple, pegs preferably situated at a distance from one another, as the result of which at least one guide surface of the guide element in turn is formed which in particular is horizontally oriented relative to the carrier element, and which for guiding the translatory motion of the connecting member correspond(s) to at least one guide surface of the guide device of the carrier element for an interaction. This results in advantages in handling as well as in manufacturing and costs.

In addition, the advantage results that the manufacture of a guide is easily implemented in terms of production engineering. The same applies for the guide element of the connecting member, which may also be provided by pegs or pins, for example.

The mutually corresponding guide surfaces of the connecting member and of the carrier element are reducible to a minimum, as the result of which manufacturing costs for an apparatus according to the invention, among other things, are achievable.

Guiding the translatory motion according to the invention reduces the freedom of motion of the connecting member relative to the carrier element of the apparatus, and forms the free movability into a movability of the connecting member which is guided relative to the carrier element. For a connection of the free ends of the carrier element according to the invention, as soon as the free ends of the carrier element have been connected to one another in a form-fit manner by a translatory motion of the connecting member relative to the guide device or the guides between a guide start and a guide end of the guide device, it is advantageous that a further undesirable, unintentional movement of the guide member does not occur. In this regard, within the meaning of the invention there are various options for preventing this type of undesirable movement of the guide member or limiting it to a tolerable degree.

To this end, according to the invention it is provided that the guide device or the first and second guides of the carrier element and the guide element of the guide member cooperate with one another, or their shapes are coordinated with one another, for independently holding the connecting member which is guided by the guide.

Against this background, in another advantageous further embodiment of the invention it is provided that the shape of the guide member and of the guide device or the guides formed at the ends of the carrier element, or the particular shape of the guide surfaces of the carrier element together with the corresponding guide surfaces of the connecting member, are coordinated with one another for self-locking holding of the connecting member which is guided by the guide device. In this regard, at least one of the guide grooves has a tapered shape in its longitudinal extension.

A self-locking action between the guide member and the guide device of the carrier element may be easily achieved by coordinating the shapes of the mutually interacting or corresponding guide surfaces with one another. Further additional connection aids with regard to a form-fit, force-fit, and integrally joined connection may thus advantageously be dispensed with, so that cost advantages are likewise achieved.

To this end, in another advantageous further embodiment of the invention it is provided that at least one of the corresponding guide surfaces of the connecting member or at least one of the guide surfaces of the carrier element is inclined, at least in sections, relative to its respective direction of longitudinal extension, which in the mounted position is oriented in the axial direction, for self-locking holding of the connecting member which is guided by the guide device.

A self-locking action hereby occurs between the joining member and the carrier element for holding the joining member on the carrier element, in particular in that the guide surface(s) of the carrier element together with the corresponding guide surface(s) of the connecting member are coordinated with one another with regard to their respective inclination in the direction of longitudinal extension. In addition, a self-locking action is a function of further factors, such as the respective angle of inclination, as well as the surface roughness of the guide surfaces in question, the material pairing, the temperature of the guide surfaces, and the presence of a lubricant, among others. For a self-locking action, it is important to configuration the resultant angle of inclination of the guide surface in question between the guide surfaces to be smaller than the arc tangent of the static friction coefficient. This accordingly applies for the tapering of the above-mentioned guide groove(s).

The guide element may also be formed by a rail, for example. In addition, within the scope of the invention it is possible for the guide element of the connecting member to be configured and designed as a guide groove, while the guide at the respective free end of the carrier element is configured as a projection or as a peg. The projection or peg may be formed in various ways. This may easily be a pin or set screw which is integrally molded onto the connecting member, for example. Furthermore, a projection may be formed as a rib having a free end. There are various ways of forming such a guide element for this purpose.

To this end, in another advantageous further embodiment of the invention it is provided that the projection and the guide, which in the mounted position are situated in a mutually corresponding manner for a form-fit connection of the free ends of the carrier element and interact with one another for guiding the movement of the connecting member, have mutually complementary shapes, at least in sections.

The guide may be formed on the carrier element in various ways. For example, it is possible to connect such a guide member, in its capacity as an additional part or component, to the carrier element and hold it on same. However, it is particularly cost-effective and simple when the first and second guides may be situated on or integrally molded onto the carrier element by means of forming processes.

To this end, within the meaning of the invention it is considered that the first and second guides are integrally molded onto the carrier element.

An integral molding may be achieved in that the guide in question may be produced, for example, by introducing an at least corresponding guide groove into the carrier element, using a forming process.

To achieve this according to the invention, it is advantageous that the internal clearance of the carrier element, configured as a clampable clamp, is preferably unimpaired by the guide device. To this end, in another advantageous further embodiment of the invention it is provided that in the mounted position, the free ends of the carrier element are each formed by a bracket which is outwardly angled or bent in the radial direction with respect to the carrier element, and whose inner sides face one another in the mounted position, and in particular the first guide and/or second guide, which are each formed in particular as a guide groove, are/is situated on at least one outer side of one of the brackets.

For connecting the free ends of the base body to one another in a form-fit manner, it is advantageous that the connecting member is shaped in such a way that in the mounted position, for their form-fit connection to one another the free ends of the carrier element overlap in the circumferential direction of the carrier element. This advantageously results in the possibility for a load-bearing connection of the free ends of the carrier element to one another, which in turn is easy to handle and control.

This results in the advantage that the area of electrical contact of the body that is electrically contacted is not impaired by the manner of connecting according to the invention.

To further reduce the handling effort and to require preferably few steps for manufacturing an apparatus according to the invention, in another advantageous further embodiment of the invention it is provided, firstly, that the carrier element has a one-part, in particular one-piece, configuration. For the same reasons, according to the invention it is provided that the carrier element has a one-part, in particular one-piece, configuration, and the connecting member has a one-part, in particular one-piece, configuration, preferably as a precision casting part.

In particular the design and configuration of a connecting member as a precision casting part allows high currents to be electrically relayed to a conductor via the precision casting part. In addition, the advantage results that a precision casting part is manufacturable in a particularly precision-fit manner, and in particular fine structures may also be implemented by the precision casting part. For this purpose, according to the invention it is provided that the connecting member is connectable or connected to the carrier element in an electrically conductive manner.

To this end, apparatus provided in another advantageous further embodiment of the invention, it is that the carrier element is configured as a precision casting part using an electrically conductive material, in particular copper or a copper alloy.

The design according to the invention of a connecting member may be carried out in many ways. To be able to achieve a connection, in a preferably space-saving manner, of the ends of the carrier element which are free in the circumferential direction, in another advantageous further embodiment of the invention it is provided that the connecting member is formed by a tubular body having an inner surface that delimits a cavity, and an outer surface, and in particular having a rectangular or circular profile cross section, at least in sections, with at least one slot which, starting from a first end-face side of the tubular body, extends, at least in sections, in the direction of the second end-face side of the tubular body, wherein, due to surface sections of the inner surface or outer surface which adjoin the mutually facing end-face sides of the slot, guide surfaces of the guide device are formed which, in the mounted position, interact with at least one guide groove or the guide surface(s) thereof of the first guide or second guide, formed on the brackets for guiding the translatory motion of the connecting member, wherein the inner surface of the tubular body or the tubular body in the longitudinal extension of the connecting member has a tapered or conical shape between the first and second end-face sides, at least in sections.

The width of the slot is dimensioned in such a way that in the mounted position, the connecting member may be pushed by means of the slot onto the brackets in the axial direction of the carrier element, as a result of which the brackets, at least in sections, are situated in the cavity of the tubular body.

This results in the advantage that in the mounted position, the ends of the carrier element formed by the above-mentioned brackets may be situated in the cavity resulting from the rectangular or circular design of the profile cross section of the connecting member. In the mounted position, the connecting member thus bridges or overlaps the free ends of the carrier element, at least in sections.

Likewise, this type of shape provides the option, for example, for easily utilizing and designing a hollow profile to form a connecting member.

For a better guiding possibility of the connecting member on the carrier element, another advantageous further embodiment of the invention provides that contact surfaces are situated on the brackets, in particular at the respective bracket end, which interact with at least one surface section of the inner surface of the tubular body in order to guide the translatory motion along at least one guide groove of the guide of the carrier element.

In cooperation with the guide groove or the guide grooves, the connecting member may interact with at least one guide surface formed on the respective guide groove, and with at least one of the contact surfaces, thus making better guiding of the translatory motion possible.

To this end, the guide surface of the guide groove is situated at a distance from the contact surface, in the radial direction of the carrier element, on at least one of the brackets.

To easily electrically connect the carrier element to a conductor, in particular a grounding cable, it is considered according to the invention that the connecting member is electrically conductive, and in particular the cable, in particular a grounding cable, in the mounted position is situated on the connecting member and is connected thereto in an electrically conductive manner, as the result of which the connecting member is in turn connectable or connected in an electrically conductive manner to the body to be electrically contacted. To this end, in another advantageous further embodiment of the invention it is provided that the connecting member is electrically conductive, and in the mounted position, in which the connecting member is situated on the guide device for a form-fit connection of free ends of the carrier element between a guide start and a guide end, the carrier element is electrically contacted, wherein in the mounted position, in particular the conductor, preferably the grounding cable, is situated on the connecting member and connected thereto in an electrically conductive manner.

The conductor may be arranged on the connecting member, for example, by pressing it to the connecting member by means of a pressure-deformable sleeve, for example. It is thus possible to electrically transfer even high currents from the body to be electrically contacted to the above-mentioned cable via an apparatus according to the invention.

This may take place via an electrically conductive connection between the above-mentioned components. Therefore, within the scope of the invention it is provided that the carrier element has an electrically conductive contact element on its inner side, which is deformable under a pressure load, and which in the mounted position faces the body to be electrically contacted, and which contacts the electrically conductive body and electrically connects same to the carrier element. A reliable electrical connection is made possible in this way.

The contact element may have a flexible design, for example made of or formed from a wire braid or a metal sheet provided with welts, which in the mounted position is situated in the circumferential direction of the carrier element so as to be removable from the carrier element.

To protect the contact point at which the conductor is or is to be contacted in an electrically conductive manner by an apparatus formed according to the invention, in another advantageous further embodiment it is provided that the base body has a sealing member which is situated on the carrier element, and which in particular has a flexible sealing strip, which in the mounted position is situated on the inner side of the carrier element which faces the body to be electrically contacted, forming a recess via which the contact device, in particular the contact element, electrically contacts the body to be electrically contacted.

In this regard, an electrical connection by means of an apparatus according to the invention is unimpaired by corrosively acting media, for example. In addition, electrical shunts may be avoided in this way.

The sealing member may also be used for electrical insulation in order to exclude shunts and allow better conduction of current.

In addition, within the scope of the invention it is considered that the flexible sealing strip may also be formed by a gel-like sealing compound. These types of sealing compounds have the advantage that they are permanently elastic and therefore have good sealing properties, even under greatly fluctuating temperatures. Furthermore, such sealing compounds conform very well to uneven surfaces. Moreover, such sealing compounds may be elastic even at low temperatures, resulting in corresponding usability of an apparatus formed according to the invention. These types of flexible gel-like sealing compounds are also known, for example, by the name polyurethane gels or also synthetic resins. Elastic as well as plastoelastic and elastoplastic sealing compounds, which may be butyl and bitumen sealing compounds as well as polyurethane sealing compounds, are likewise suitable as sealing compounds.

To increase the reliability of the form-fit connection of the free ends of the carrier element via the connecting member, in another advantageous further embodiment of the invention it is provided that the connecting member is secured against movement on the guide by a securing member, in particular a clamping screw, to be able to effectively prevent undesirable shifting of the connecting member, even under high forces or vibrations.

In another advantageous further embodiment of the invention, it is provided that the conductor is held on the connecting member in a force-fit, form-fit, or integrally joined manner, so that a holding effect may also be achieved by any combination of the above-mentioned types of closures.

It is thus advantageously possible to easily and securely mount or hold the conductor on the connecting member in a fixed as well as removable manner, in that, for example, a holding effect may be achieved by welding, soldering, gluing, or also clamping.

To this end, in another advantageous further embodiment of the invention it is provided that the conductor is held on the connecting member under a clamping effect. A simple option for arranging the conductor on the connecting member is thus achieved, so that further aids or additional materials may be dispensed with.

In this way, an apparatus according to the invention may also be used in areas in which increased safety is required. In addition, this avoids the situation that adverse circumstances may result in the connection of the free ends of the carrier element which are connected to one another coming loose, or the security of the form-fit connection by the connecting member being reduced.

The invention is explained in greater detail below with reference to the appended drawings, in which embodiments of an apparatus according to the invention for making electrically conductive contact with an electrically conductive, in particular elongated, for example substantially cylindrical, body, are illustrated. All features that are claimed, described, and illustrated in the drawings, alone or in any combination, constitute the subject matter of the invention, regardless of their recapitulation in the written description, and regardless of their description or illustration in the drawings. In particular, the invention is therefore not limited to the embodiments shown in the figures.

The figures of the drawing are based on a schematic representation. The illustrations are therefore not true to scale, and for better clarity are reduced to the elements or components which assist in better understanding. In the figures, identical elements or components are provided with the same reference numerals, or are shown in the same illustration or in a correspondingly representative view.

For better clarity, all reference numerals are not always inscribed in the individual figures, so that a reference to the individual elements or components may also be made via the corresponding identical illustration or an analogous view representation.

Relative terms such as left, right, up, and down are for convenience only and are not intended to be limiting.

DETAILED DESCRIPTION OF THE INVENTION

Figure 1:
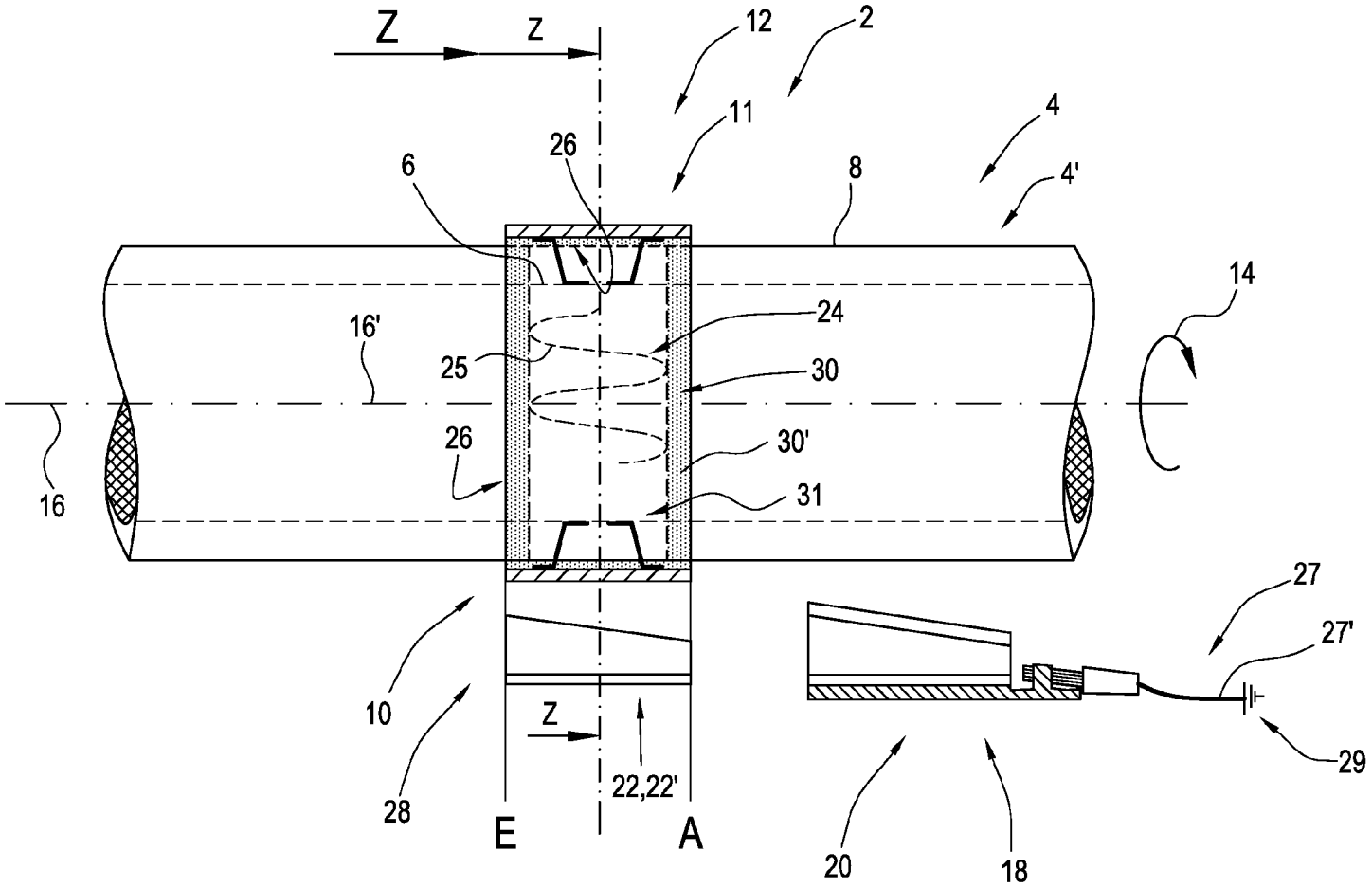
FIG. 1 shows one embodiment of an apparatus according to the invention for making electrically conductive contact with an electrically conductive, in particular elongated, for example substantially cylindrical, body, for example a pipe or a cable, in a schematic representation in a partial sectional illustration along the axis of the carrier element, the illustrated connecting member being analogously shown in a sectional illustration (schematic longitudinal illustration)

FIG. 1 shows a first embodiment of an apparatus 2 according to the invention for making electrically conductive contact with an electrically conductive, in particular elongated, substantially cylindrical, body 4, and in this embodiment is an apparatus 2 according to the invention for making electrically conductive contact with an outer conductor 6 of a coaxial cable 4', the conductor being bared, at least in sections, and springing back radially with respect to a sheathing 8 of the coaxial cable 4'. The embodiment of an apparatus 2 according to the invention, as previously described, is denoted below as apparatus 2 for short.

The apparatus is provided with a base body 11, which at least one carrier element 12 which is open in the circumferential direction 14 and which is provided around the body 4 to be contacted or around the coaxial cable 4' to be contacted. The circumferential direction 14 is symbolized by a curved arrow in FIG. 1.

In addition, FIG. 1 shows the axis 16 of the coaxial cable 4', with respect to which the sheathing 8 of the coaxial cable 4' springs back radially, coaxially with respect to the carrier element 12 of the apparatus 2 according to the invention which is mounted on the coaxial cable 4' in the mounted position, around which the carrier element 12, designed as a clampable clamp 10, is situated.

The apparatus 2 is also provided with a connecting device 18 which has a connecting member 20 via which the ends 22, 22' of the carrier element 12, which are free in the circumferential direction 14, and which may be termed first free end 22 and second free end 22' respectively, are connected to one another in the mounted position shown. For better clarity, the connecting member 20 is illustrated next to the carrier element 12 onto which it may be pushed In addition, the apparatus 2 has a contact device 24 for establishing an electrically conductive connection between the body 4 to be contacted or the outer conductor 6, bared in sections, of the coaxial cable 4', and a conductor 27, which in this embodiment is a grounding cable 27'. It is thus possible for very high voltages and currents, which occur during lightning strikes, for example, to be diverted from the body 4 via the apparatus 2, for example in order to "ground" the body.

In the apparatus 2, the connecting member 20 is configured and designed for cooperating with the guide device 28, situated at the free ends 22, 22' of the carrier element 12, for guiding the translatory motion of the connecting member 20, in such a way that in the mounted position of the apparatus 2 shown in FIG. 1, a translatory motion of the connecting member 20 between a guide start (A) and a guide end (E) of the guide device 28 brings about a form fit, which is in particular nondestructively detachable, for connecting the free ends 22, 22' of the carrier element 12.

A form-fit connection of the free ends 22, 22' of the carrier element 12 via the connecting member 20 is thus achievable. The form-fit connection of the above-mentioned free ends 22, 22' takes place by means of the connecting member 20.

In FIG. 1, the guide start of the guide device 28 is denoted by reference character A and the guide end of the guide device 28 is denoted by reference character E, resulting in a preferred direction in which the movement of the connecting member 20 is guided by the connecting device 18 for connecting the free ends 22, 22' of the carrier element 12.

According to the invention, it is considered that the above-mentioned guide start A may optionally also form the above-mentioned guide end E of the guide device 28, and vice versa.

It is apparent in FIG. 1 that the grounding cable 27' is situated on the connecting member 20, to which it is mechanically as well as electrically connected by means of a pressing operation.

The grounding cable 27' is also electrically connected to a grounding potential 29, which is represented by a corresponding arrow symbol in FIG. 1.

In addition, the apparatus 2 has a sealing member 30 which is used for protecting the outer conductor 6, bared in sections for the electrical contacting, of the coaxial cable 4' from corrosive damage to the outer conductor 6 or from media having a corrosive action on the body 4 to be electrically contacted.

Accordingly, the base body 11 has a corresponding sealing member 30 which is situated on the carrier element 12 and which has a flexible sealing strip 30', which in the mounted position shown is situated on an inner side 26 of the carrier element 12 facing the body 4 to be electrically contacted, forming a recess 31 via which the contact device 24, in particular the contact element 25, electrically contacts the body 4.

Thus, the contact device 24 has at least one electrically conductive contact element 25 which is deformable under a pressure load, and which in the mounted position contacts the body 4 to be electrically contacted and electrically connects same to the carrier element 12, the contact element 25 being situated on the inner side 26 of the carrier element 12 facing the body 4 in the mounted position.

Further details of the apparatus 2 are explained with reference to the figures described below.

Figure 2:
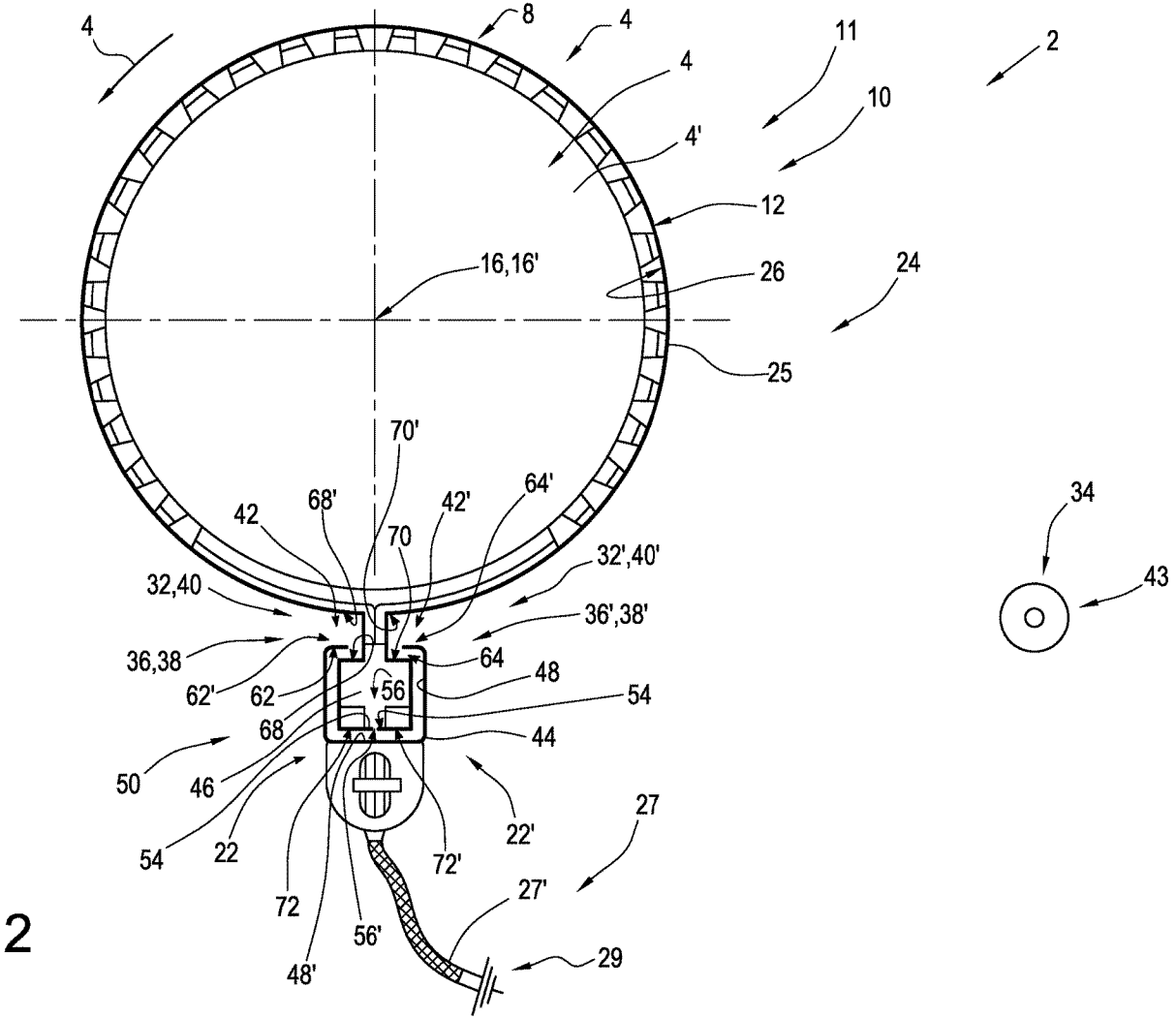
FIG. 2 shows the apparatus 2 in a sectional illustration denoted by reference character z-z within FIG. 1, in a schematic representation.

FIG. 2 shows the apparatus 2 in a sectional illustration denoted by reference character z-z within FIG. 1, in a schematic representation. The carrier element 12 is configured and designed for connection of its ends 22, 22', which are free in the circumferential direction 14, in such a way that at each of the above-mentioned free ends 22, 22' at least one guide 32, 32' for the connecting member 20 is formed, which in the mounted position of the apparatus 2 guides the connecting member 20 for a translatory motion in the axial direction 34 with respect to the carrier element 12. The axial direction 34 is denoted by a dot-in-circle symbol in FIG. 2.

The connecting member 20 which is inserted, at least in sections, into the respective guide 32, 32' between the respective guide start A and the respective guide end E by means of at least one guide element 36, 36' brings about a form-fit connection of the free ends 22, 22' of the carrier element.

In this embodiment of an apparatus 2 according to the invention, the respective guide 32, 32' is designed as a linear guide 38, 38', so that the movement of the connecting member is guided essentially, or in sections, linearly by the respective linear guide 38, 38' in the axial direction 34 with respect to the carrier element 12.

To this end, the apparatus 2 is configured and designed in such a way that the guide device 28 for the connecting member 20 is formed by at least one first guide 32 situated at one free end 22 of the carrier element 12, and by a second guide 32' situated at the remaining free end 22', the first guide 32 and the second guide 32' each being elongated in the axial direction 34.

The first guide 32 and the second guide 32' have a guide groove 40, 40', respectively, which is elongated in the axial direction 34 with respect to the carrier element 12, and with which a guide element 36, 36', respectively, of the connecting member 20 engages, at least in sections, for guiding the translatory motion of the connecting member 20.

To be able to guide the connecting member 20 via the particular guide with regard to a translatory motion, the connecting member 20 engages, at least in sections, with the guide groove 40 of the first guide 32 and with the guide groove 40' of the second guide 32' by means of a guide element 36, 36', respectively.

For this purpose, in this embodiment of an apparatus 2 according to the invention, the guide element 36, 36' of the connecting member 20 is formed by a projection 42, 42', respectively, which extends transversely with respect to the direction of the longitudinal extension 43 of the connecting member 20, and thus, toward the respective guide groove 40, 40', in the mounted position, with which the projection engages, at least in sections. The direction of longitudinal extension 43 is once again represented by a dot-in-circle symbol.

Alternatively, it is possible to replace at least one of the projections 42, 42' by pegs which are situated, for example, adjacently or at a distance from one another in the direction of longitudinal extension 43 of the connecting member 20.

The connecting member 20 is formed by a tubular body 44 having an inner surface 48 which delimits a cavity 46, and an outer surface 50, and in particular having a rectangular profile cross section, at least in sections, with at least one slot 56 which, starting from a first end-face side 52 of the tubular body 44, extends, at least in sections, in the direction of the second end-face side 54 of the tubular body, and forms an opening 56' in the tubular body 44 from the outer surface 50 to the cavity 46, wherein guide surfaces 62, 62', 64, 64' of the guide device 28 are formed by the surface sections 60, 60' of the inner surface 48 or outer surface 48 which adjoin the mutually facing end-face sides 58, 58' of the slot 56, and which in the mounted position interact with at least one guide groove 40, 40' or the guide surfaces 68, 68', 70, 70' thereof of the first guide 32 or second guide 32', formed on the brackets 66, 66' (explained below) for guiding the translatory motion of the connecting member 20, wherein the inner surface 46 of the tubular body 44 as well as the outer surface 50 of the tubular body 44 in the longitudinal extension 43 of the connecting member 20 have a conical shape, at least in sections, between the first end-face side 52 and the second end-face side 54.

This results in guide surfaces 62, 62', 64, 64' in each case via which the connecting member 20 corresponds to or interacts with the respective guide surfaces 68, 68', 70, 70' of the first and second guides 32, 32' in order to guide the translatory motion of the connecting member 20.

For easier handling of the apparatus 2 and more secure holding of the connecting member 20 on the carrier element 12, the respective guide surfaces 62, 62', 64, 64' of the connecting member 20 cooperate with the corresponding guide surfaces 68, 68', 70, 70' of the guide device 28 of the carrier element 12 for self-locking holding of the connecting member 20 which is guided by the guide device 28, so that the shape of the respective guide surfaces 46, 48 is coordinated with the corresponding guide surfaces 50, 52 of the connecting member 20 for self-locking holding of the connecting member 20 which is guided by the guide device 28.

For this purpose, the guide surfaces 62, 62', 64, 64' and 68, 68', 70, 70' in their respective longitudinal extension, which in the mounted position runs in the axial direction 34, are inclined with respect to the axis of the cable 16 or the axis of the carrier element 16' in the mounted position, so that in the mounted position, the respective guide groove 40, 40' has a tapered shape in the axial direction 34.

For self-locking, the angle of inclination of the corresponding guide surfaces 62, 64, 68, 70 is a function of the static friction coefficient of their respective surface, so that it is known to those skilled in the art that the angle of inclination that results between the mutually corresponding guide surfaces 62, 64, 68, 70 should be designed to be less than or equal to the arc tangent of the static friction coefficient.

In addition, the brackets 66, 66' have at least one contact surface 72, 72', respectively, in particular at the respective free end 22, 22' of the carrier element 12, which interacts with or corresponds to at least one surface section 48' of the inner surface 48 of the tubular body 44 in order to guide the translatory motion along at least one guide groove 40, 40' of the first and second guides 32, 32' of the carrier element 12.

Figure 3:
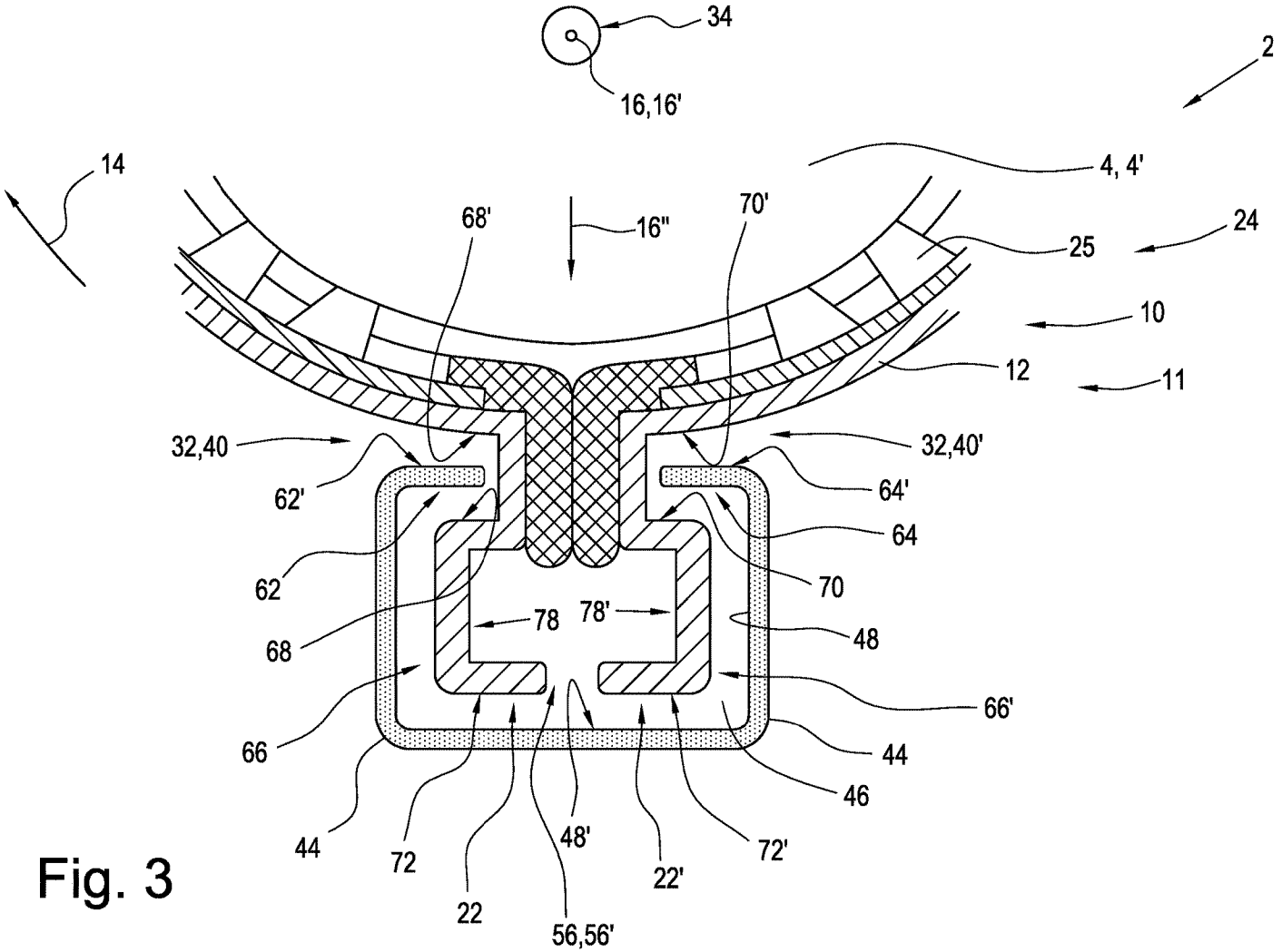
FIG. 3 shows a portion of the apparatus 2 in a mounted position in the same illustration as in FIG. 2, in a schematic representation.

FIG. 3 shows the apparatus 2 in the same illustration as in FIG. 2, but reduced to a section of the apparatus 2 or the body 4 to be contacted shown in FIG. 2. It is apparent from the illustration that the projection 42, 42' and the first and second guides 32, 32', which in the mounted position shown mutually correspond or interact with one another for a form-fit connection of the free ends 22, 22' of the carrier element 12, have complementary shapes, at least in sections.

The apparatus 2, as already stated above, is characterized in that in the mounted position shown, the free ends 22, 22' of the carrier element 12 are formed by brackets 66, 66', respectively, which are outwardly angled or bent in the radial direction 16" with respect to the carrier element 12, and whose inner sides 78, 78' face one another in the mounted position shown, and in particular the first guide 32 and second guide 32', which are formed in particular as a guide groove 40, 40', respectively, are situated on at least one outer side 80, 80' of a bracket 66, 66'.

The sealing member 29 mentioned above is used for protecting the area 82 of the electrical contacting between the apparatus 2 and the body 4, 4' to be electrically contacted, in which the outer conductor 6 of the coaxial cable 4' is bared in sections for the electrical contacting, in particular from corrosion due to environmental influences, and from media which have a tendency to adversely affect the contact between the apparatus 2 and the body 4, 4' to be electrically contacted.

Figure 4:
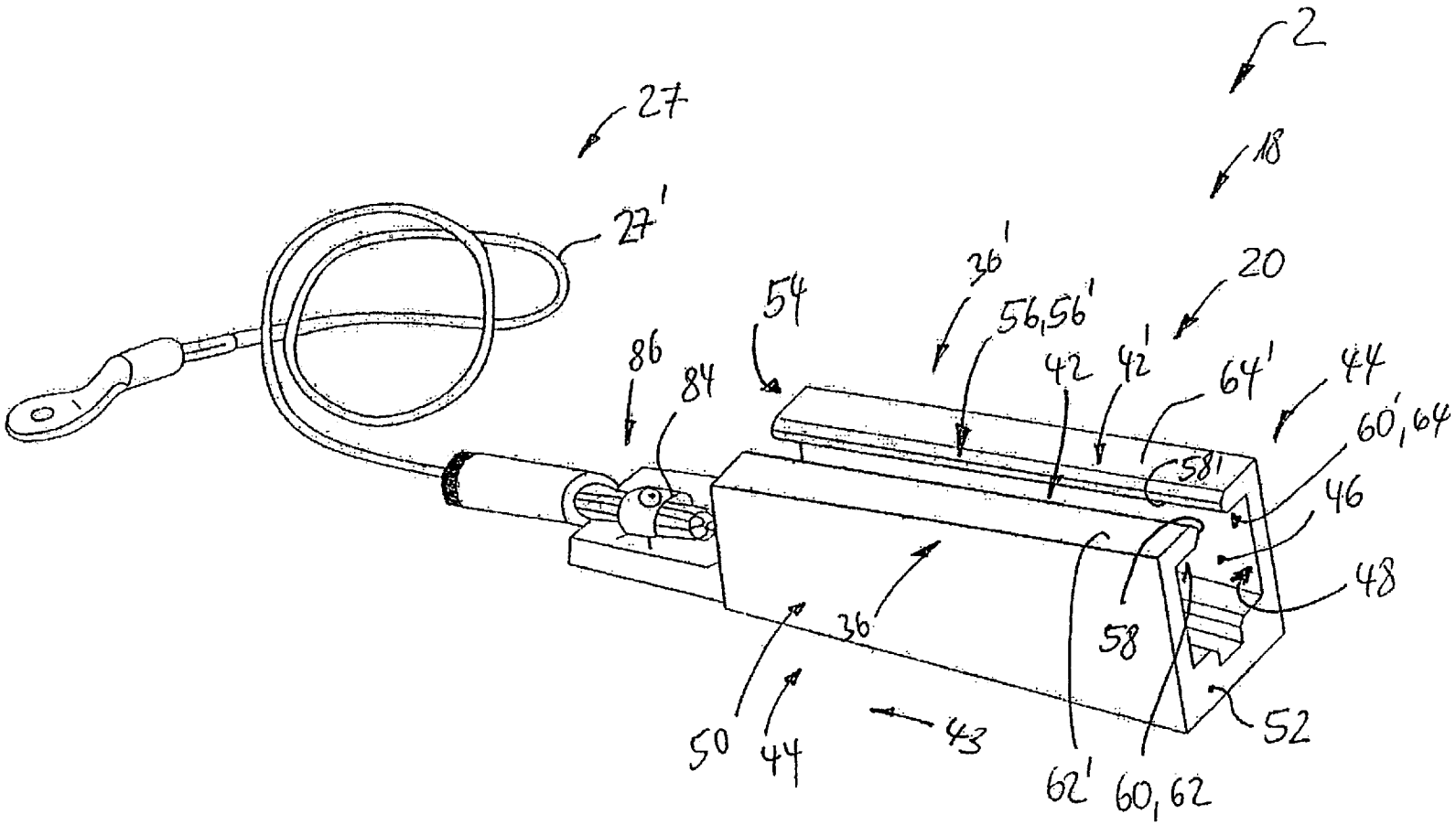
FIG. 4 shows the connecting member of the apparatus 2 in an isometric view and in a schematic representation.

FIG. 4 shows the connecting member of the apparatus 2 in a perspective schematic view. The connecting member 20 is formed in one piece as a precision casting part.

The grounding cable 27' is situated on the connecting member 20 with a force fit, and is held on same via a sleeve 84 which has been formed for this purpose in a forming process. To this end, the free end 86 of the conductor 27, 27' which is bared, at least in sections, is insertable into the sleeve 84, and is connectable or connected by deforming or pressing the sleeve 84 tightly against the connecting member 20.

Figure 5:
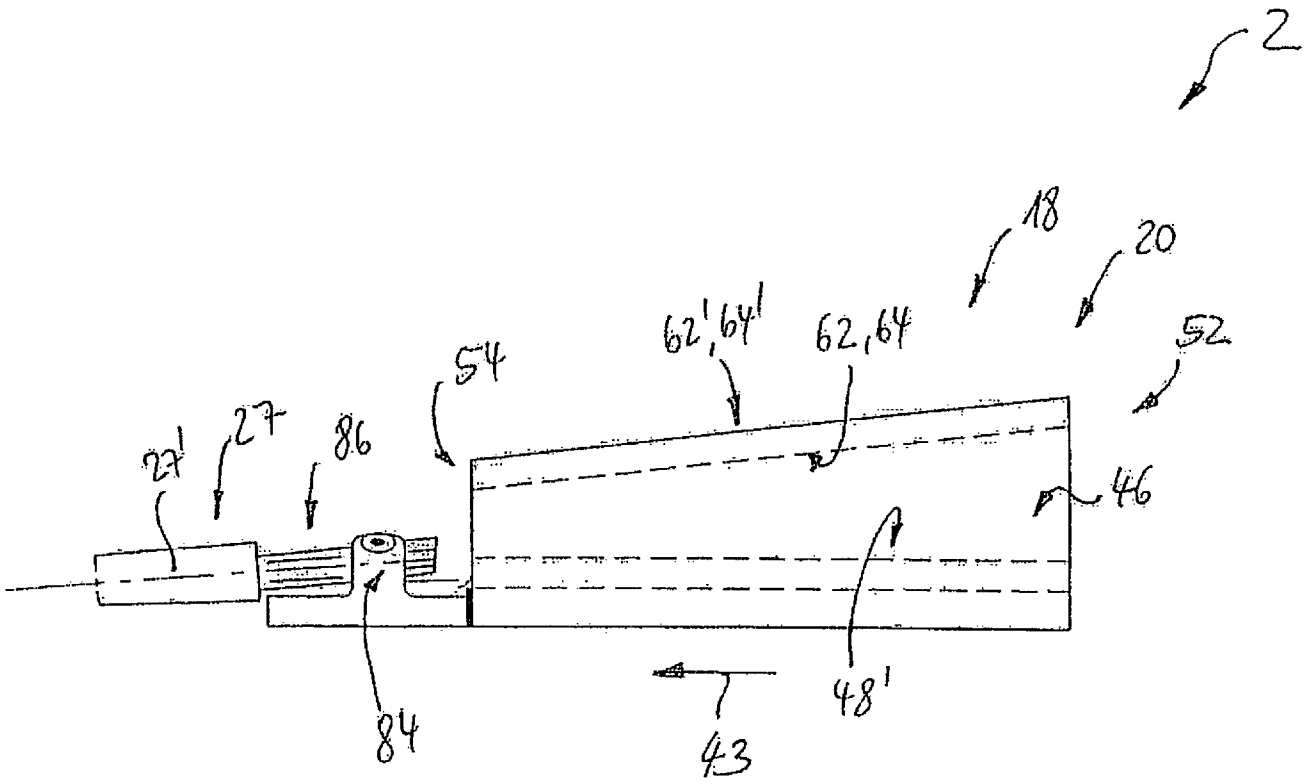
FIG. 5 shows the connecting member in a longitudinal cross section, in a schematic representation.

FIG. 5 shows the connecting member in a longitudinal cross section.

Figure 6:
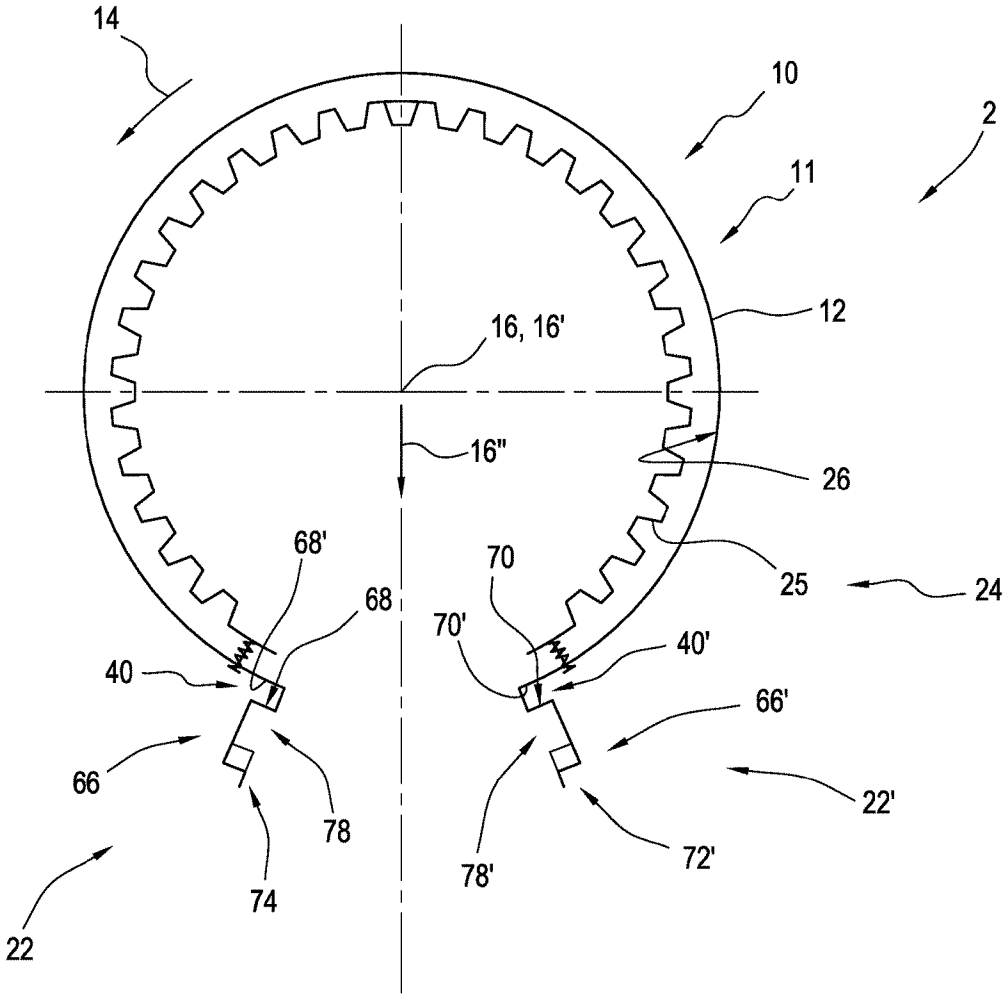
FIG. 6 shows the carrier element in a cross-sectional illustration, in a schematic representation.

FIG. 6 shows the carrier element in a cross-sectional illustration. It is apparent from the illustration in FIG. 6 that the carrier element 12 is likewise formed in one piece by a band-shaped metal carrier element 10 made of stainless steel.

Accordingly, the brackets 66, 66' are likewise made of a metal or stainless steel.

As a result, electrical conduction occurs from the body 4 to be electrically contacted, via the contact device 24 and the carrier element 12, to the connecting member 20, and lastly, to the conductor 27 or grounding cable 27' situated thereon.

It is apparent that the connecting member takes on a double function, in which it connects the free ends 22, 22' of the carrier element 12 to one another, and in a manner of speaking, an electrical line is formed from the body 4 to be contacted to the conductor 27 or grounding cable 27'.

For electrical contacting, the contact device 24 has

Figure 7:
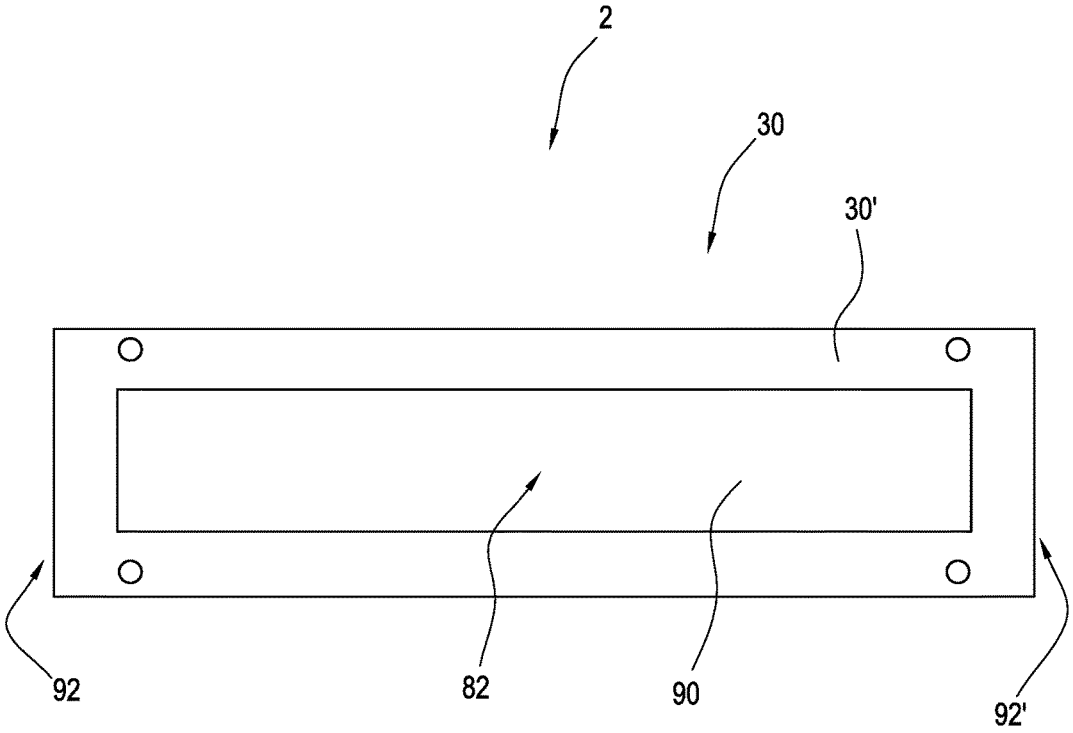
FIG. 7 shows the sealing member of the first embodiment of an apparatus according to the invention in a top view, in which the sealing member in a layout illustration as a strip in a schematic representation.

FIG. 7 shows the sealing member 30 in a top view, in which the sealing member 30 is shown in a layout illustration as a flexible sealing strip 30' in a schematic representation, which in this embodiment is formed from a flexible sealing strip 30' in which an inner area 88 for electrically contacting the body 4 to be electrically contacted has a recess 90 via which the contact device 24 contacts the body 4 to be contacted or the outer conductor 6 of the coaxial cable 4'.

The sealing member 30 is made of an elastic material, in the present embodiment an elastomer, and is removably situated on the inner side 26 of the carrier element 12, which in the mounted position faces the body 4, 4' to be electrically contacted.

The sealing member 30 extends up to the brackets 66, 66', and in the mounted position of its free ends 92, 92' is clamped between the brackets as soon as the free ends 22, 22' of the carrier element 12 become/are connected to one another with a form fit by the connecting member 20.

The apparatus 2 thus has the advantage that the sealing member 30 is uniformly pressed together in the area of the brackets 66, 66', so that leaks due to formation of corrugations of the sealing member 30 in the area of the brackets 66, 66' are effectively avoided.

Figure 8:
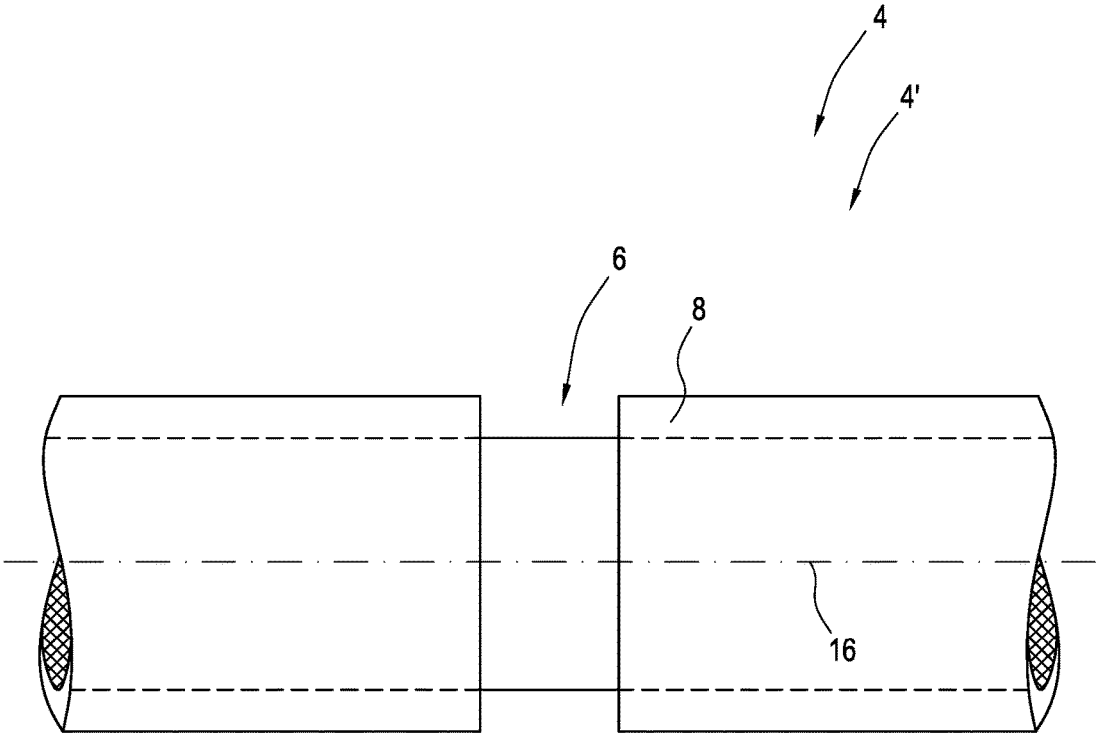
FIG. 8 shows a portion of a coaxial cable as an example of a body to be electrically contacted with an outer conductor which is bared in sections, and which springs back radially with respect to a sheathing of the coaxial cable, in a schematic side view.

FIG. 8 shows a section of a coaxial cable 4' as an example of the body 4 to be electrically contacted with an outer conductor 6 which is bared in sections, and which springs back radially with respect to the sheathing 8 of the coaxial cable 4'.

Figure 9:
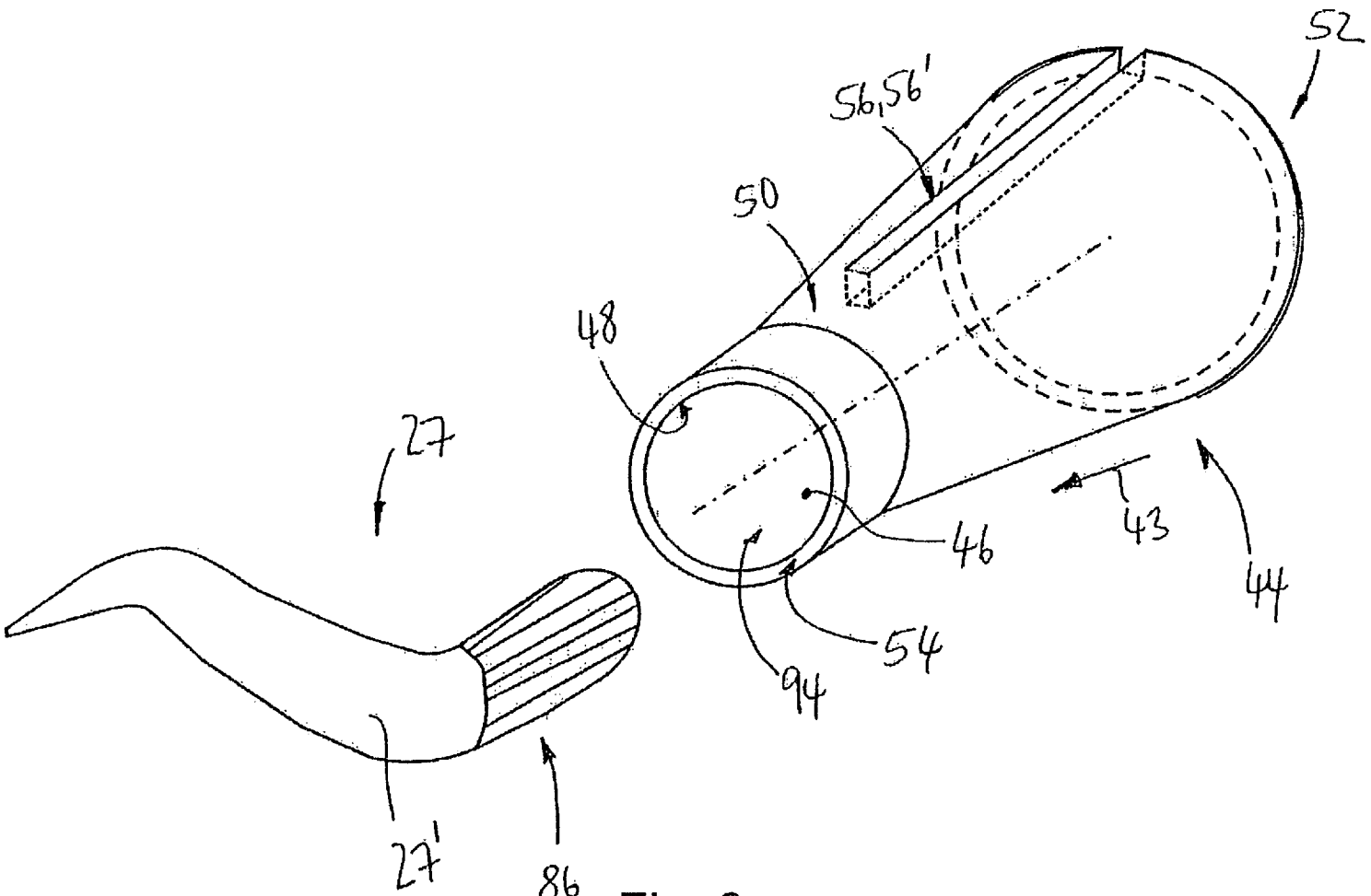
FIG. 9 shows a second embodiment of an apparatus according to the invention in a schematic perspective view, the illustration being reduced to a connecting member with a grounding cable (of which a portion is illustrated) situated thereon.

FIG. 9 shows a second embodiment of an apparatus 2 according to the invention in a schematic perspective view, in which the illustration is reduced to a connecting member with a grounding cable (of which a portion is illustrated) situated thereon. The second embodiment of an apparatus 2 according to the invention is also referred to below as apparatus 2 for short. The apparatus 2 shown in FIG. 9 conforms to the first embodiment of an apparatus 2 according to the invention, as shown and explained with reference to FIGS. 1 to 8. However, there is the difference that the apparatus 2 in FIG. 9 uses a circular tubular body 44 for forming the connecting member 20. In addition, the connecting member 20 of the apparatus is designed in such a way that the conductor 27 or the grounding cable 27' is insertable in sections directly at the opening 94 in the tubular body 44, and after it is inserted in sections into the tubular body 44, it is held on the tubular body 44 by deformation or pressing of same, the tubular body being deformed by application of a compressive force in order to hold the conductor 27 in question on the connecting member 20 by means of a clamping effect. For this purpose, the tubular body 44 has a cylindrical shape in the vicinity of the second end-face side 54, wherein the conicity in this area in which the conductor 27 is inserted into the tubular body 44 or the connecting member 20 is essentially eliminated.

Figure 10:
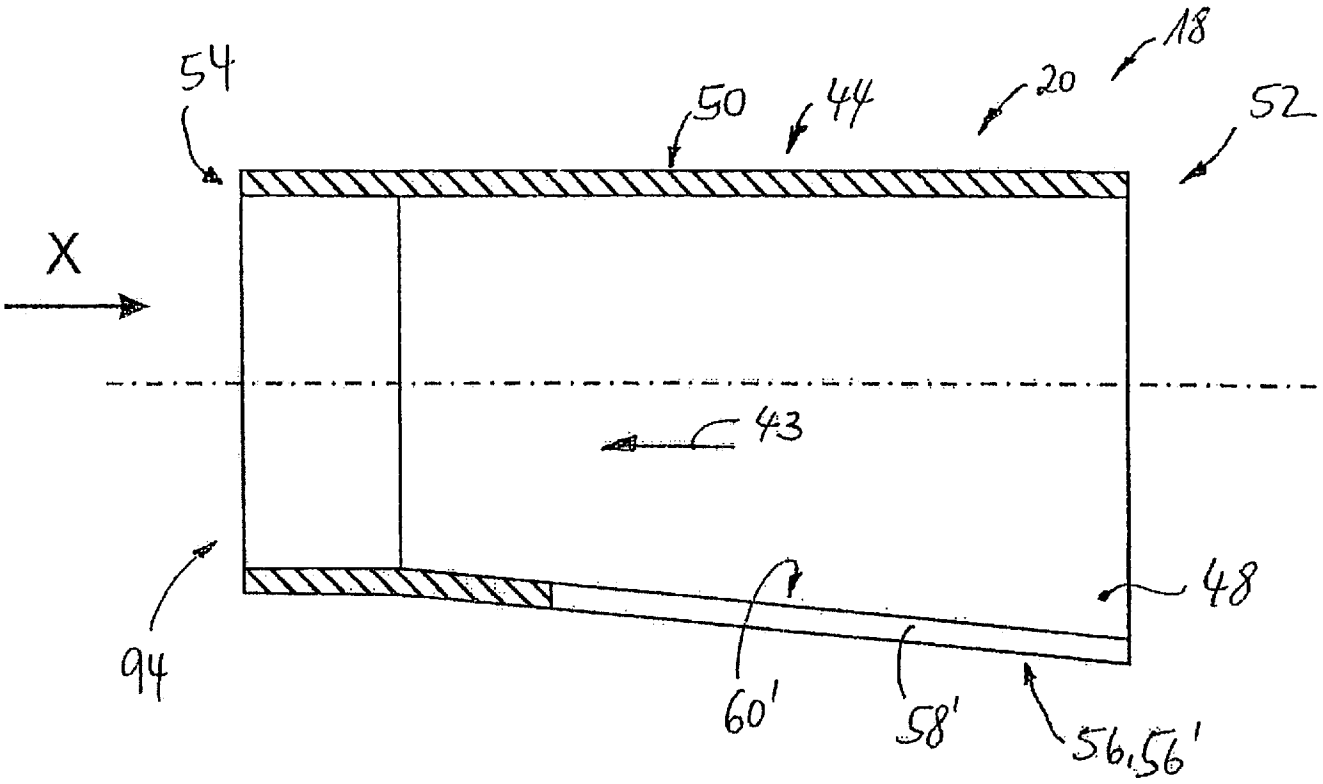
FIG. 10 shows the connecting member shown in FIG. 9 in a longitudinal illustration of the second embodiment of an apparatus according to the invention.

FIG. 10 shows the connecting member 20 of the second embodiment of an apparatus 2 according to the invention illustrated in FIG. 9, in a longitudinal sectional illustration. It is apparent in FIG. 10 that the tubular body 44 has a tapered or conical shape in sections in its direction of longitudinal extension 43 from the end-face side 52 toward the end-face side 54.

Thus, an example is shown for holding the conductor 27 on the connecting member 20 under a clamping effect.

In addition, it is possible to situate the conductor 27 on the connecting member, using a coupling/plug combination. Approaches having a design as an electrically conductive clamp, for example, are suitable for this purpose.

It is clear to those skilled in the art that components which are used for the electrical conduction must correspondingly be electrically conductive.

Numerous embodiments result with regard to an apparatus according to the invention, of which a selection is illustrated in the above-mentioned figures.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

What is claimed is:

1. An apparatus for making electrically conductive contact with an electrically conductive body, comprising:

a) a base body having a metal carrier element which is configured as a clamp which is clampable around a body to be contacted, and which is open in a circumferential direction;

b) a connecting device which has a connecting member, via which a first free end and a second free end of the carrier element that are free in the circumferential direction are connectable or connected to one another in a mounted position;

c) a contact device for establishing an electrically conductive connection between the body to be contacted and a conductor;

d) the connecting member cooperating with a guide device for guiding a translatory motion of the connecting member, the guide device being situated at the first and second free ends of the carrier element, so that in the mounted position of the apparatus, a translatory motion of the connecting member between a guide start and a guide end of the guide device brings about a nondestructively detachable form fit for connecting the first and second free ends of the carrier element; and e) the connecting member is electrically conductive and electrically contacts the carrier element, wherein in the mounted position, the conductor is situated on the connecting member and is connected thereto in an electrically conductive manner.

2. The apparatus according to claim 1, wherein:

a) the guide device for the connecting member has a first guide situated at one of the first and second free ends of the carrier element, a second guide is situated at the remaining one of the first and second free ends, and at least one of the first guide and the second guide is elongated in the axial direction.

3. The apparatus according to claim 2, wherein:

a) the first guide and the second guide are each configured as a linear guide, at least in sections.

4. The apparatus according to claim 2, wherein:

a) the first guide and the second guide are integrally molded onto the carrier element of the base body.

5. The apparatus according to claim 2, wherein:

a) the first guide and the second guide each have at least one guide groove which is elongated in the axial direction with respect to the carrier element, and with which in each case at least one guide element of the connecting member engages, at least in sections, for guiding the translatory motion of the connecting member.

6. The apparatus according to claim 4, wherein:

a) the guide element of the connecting member is formed by at least one projection, directed toward the guide groove in the mounted position, or a protruding welt directed toward the guide groove, or at least one, in particular multiple, pegs, as the result of which at least one guide surface is formed on the connecting member, and which for guiding the translatory motion of the connecting member corresponds to at least one guide surface of the guide device of the carrier element.

7. The apparatus according to claim 6, wherein:

a) the particular shapes of the at least one guide surface of the guide device of the carrier element together with the at least one guide surface of the connecting member are coordinated with one another for self-locking holding of the connecting member which is guided by the guide device.

8. The apparatus according to claim 6, wherein:

a) at least one of the at least one guide surface of the connecting member or the at least one guide surface of the carrier element is inclined, at least in sections, with respect to the axis of the carrier element relative to its respective direction of longitudinal extension, which in the mounted position is oriented in the axial direction, for self-locking holding of the connecting member which is guided by the guide device.

9. The apparatus according to claim 6, wherein:

a) the projection and one of the first guide and the second guide, which in the mounted position are situated in a mutually corresponding manner for a form-fit connection of the free ends of the carrier element, have mutually complementary shapes, at least in sections.

10. The apparatus according to claim 2, wherein:

a) in the mounted position, the free ends of the carrier element are each formed by a bracket which is outwardly angled or bent in the radial direction with respect to the carrier element, and whose inner sides face one another in the mounted position, and one of the first guide and the second guide is formed as a guide groove, and is situated on at least one outer side of the bracket.

11. The apparatus according to claim 10, wherein:

a) the connecting member is formed by a tubular body having an inner surface that delimits a cavity, and an outer surface, with at least one slot which, starting from a first end-face side of the tubular body, extends, at least in sections, in a direction of a second end-face side of the tubular body, and forms an opening in the tubular body from the outer surface into the cavity, wherein, due to the surface sections of the inner surface or outer surface which adjoin the mutually facing end-face sides of the slot, guide surfaces of the guide device are formed which, in the mounted position, interact with at least one guide groove or the guide surface(s) thereof of the first guide or second guide, formed on the brackets for guiding the translatory motion of the connecting member, wherein at least the inner surface of the tubular body, has a tapered or conical shape between the first end-face side and the second end-face side, at least in sections.

12. The apparatus according to claim 10, wherein:

a) contact surfaces are situated on the bracket, the contact surfaces interact with at least one surface section of the inner surface of the tubular body in order to guide the translatory motion along at least one guide groove of the guide of the carrier element.

13. The apparatus according to claim 1, wherein:

a) the contact device has at least one electrically conductive contact element which is deformable under a pressure load, and which contacts the body to be electrically contacted and electrically connects same to the carrier element, wherein the contact element is situated on an inner side of the carrier element, which in the mounted position faces the body to be contacted.

14. The apparatus according to claim 1, wherein:

a) the base body has a sealing member which is situated on the carrier element, and which has at least one flexible sealing strip, which in the mounted position is situated on an inner side of the carrier element which in the mounted position faces the body to be electrically contacted, forming a recess via which the contact device, electrically contacts the body to be electrically contacted.

15. The apparatus according to claim 2, wherein:

a) the connecting member is secured against movement on the one of the first guide and the second guide by a securing member.

16. The apparatus according to claim 1, wherein:

a) the carrier element has a one-part configuration, and the connecting member has a one-part configuration.

17. The apparatus according to claim 1, wherein:

a) the carrier element is an electrically conductive material.

18. The apparatus according to claim 1, wherein:

a) the conductor is held on the connecting member under a clamping effect.

19. The apparatus according to claim 1, wherein:

a) the conductor is held on the connecting member in a force-fit, form-fit, or integrally joined manner.

20. The apparatus according to claim 1, wherein:

a) the body is an elongated body.

* * * * *